United States Patent [19]

Hirt

[11] 4,292,020

[45] Sep. 29, 1981

[54] METHOD AND APPARATUS FOR ABATEMENT OF GASOLINE VAPOR EMISSIONS

[75] Inventor: John H. Hirt, Fullerton, Calif.

[73] Assignee: Hirt Combustion Engineers, Montebello, Calif.

[21] Appl. No.: 44,037

[22] Filed: May 31, 1979

[51] Int. Cl.[3] ..... F23D 13/20

[52] U.S. Cl. ..... 431/5; 431/202

[58] Field of Search ..... 431/5, 12, 43, 51, 202, 431/281, 284, 285; 220/85 VR, 85 VS; 141/45, 46, 192; 222/318; 422/168

[56] References Cited

U.S. PATENT DOCUMENTS

| | | | |
|---|---|---|---|
| 1,676,877 | 7/1928 | String | 431/51 |
| 3,817,687 | 6/1974 | Cavallero et al. | 431/202 |
| 3,826,604 | 7/1974 | Rulesh | 431/12 |
| 3,837,785 | 9/1974 | Evans et al. | 431/5 |
| 3,887,324 | 6/1975 | Reed et al. | 431/5 |
| 3,897,193 | 7/1975 | Kattan et al. | 431/5 |
| 3,902,874 | 9/1975 | McAndrew | 220/85 V |
| 3,914,095 | 10/1975 | Straitz | 431/202 |
| 3,999,936 | 12/1976 | Hasselmann | 431/202 |
| 4,009,985 | 3/1978 | Hirt | 431/5 |
| 4,118,170 | 10/1978 | Hirt | 431/5 |

*Primary Examiner*—Samuel Scott
*Assistant Examiner*—Randall L. Green
*Attorney, Agent, or Firm*—Poms, Smith, Lande & Rose

[57] ABSTRACT

A method and apparatus for installing, controlling and operating a vapor control system for abating gasoline vapor emissions which occur at a gasoline service station during transfer of liquid gasoline from a gasoline supply tank truck to underground storage containers at the station and also during transfer of liquid gasoline from the underground storage containers to the gasoline tank of a vehicle through a service station gasoline pump. Each gasoline pump includes a dispensing nozzle having vapor return means communicating with the underground storage containers and also the vehicle tank. The underground storage containers have a vent means in communication with vapor collected in said storage container, with the vapor return means and with a vapor conducting line and vent line leading to a disposal means. The disposal means comprises a single burner and pilot means therefor. The service station is provided with a source of pressure air for directing gasoline vapors to the disposal means as by a suction pumping means, without use of electrical power in proximity to vapors, and to actuate valve means in the vapor conducting line to permit flow of vapors to the disposal means. Gaseous pressure in the vent means or vapor conducting line is sensed by two pressure sensing switches which, when pressure air is available, control said valve means for directing flow of vapors to the disposal means under gasoline pump-on conditions and also under diurnal conditions which affect pressure of gaseous vapors. An apparatus and method providing control of gasoline vapor emissions and providing inherent safety features, simplicity, efficiency, and long life.

4 Claims, 3 Drawing Figures

METHOD AND APPARATUS FOR ABATEMENT OF GASOLINE VAPOR EMISSIONS

BACKGROUND OF INVENTION

The present invention contemplates an improved method and apparatus for abatement of gasoline vapor emissions at a service station or any location where liquid gasoline is transferred from one container or tank to another and particularly relates to certain modifications, improvements, and additional safety features in the apparatus and method of abatement of vapor emissions as described in U.S. Pat. Nos. 4,009,985 and 4,118,170 owned by a common assignee. The patents describe service station vapor emission conditions in detail and such description and subject matter of said patents are incorporated herein by reference.

Generally speaking, these patents disclose an apparatus and method for controlling vapor emissions wherein the system preferably operates under a slight vacuum, arranged to permit collected gasoline vapors in the system to recondense in the underground storage containers, provides equilibrium or saturated vapors to blanket the stored liquid gasoline from air thus preventing further evaporation of gasoline, provides vapors to replace gasoline dispensed, suppresses the formation of excess vapors, and thermally oxidizes any excess vapors in the system into carbon dioxide and water vapor which are clean, odorless, invisible and nonpolluting. Such patents disclose multistage burners for disposing of the vapors, each burner being adapted to operate under certain specified conditions.

Generally speaking, excess gasoline vapors at a gasoline service station may occur as a result of diurnal conditions; that is, breathing vapor losses caused by alternate expansion and contraction of storage container contents due to day and night temperature and pressure differentials. During transfer of liquid gasoline to or from a vehicle tank and storage container, displacement losses occur upon refilling a partially empty or empty storage tank which may normally expel an equivalent volume of vapor through the vent pipe of the storage container. Further, when an automobile tank is filled with fresh gasoline, more gasoline vapors are produced as gasoline is dispensed. The volume of vapors discharged from a vehicle tank during such refueling may be from 2% to 15% greater than the liquid volume of the gasoline dispensed.

Further, in some prior proposed emission control systems, a slight vacuum may be present at the gasoline pump dispensing nozzle which may be provided sealing relation with the fill pipe of the vehicle tank; and within the remainder of the system such as the storage tanks, vent line and disposal means, a blower system is employed to move the vapors to the disposal means under positive pressure. In such prior proposed system, there may be considerable pressure variation as from for example, 3" to 20" of water column. As a result, operation of the burner means at the disposal means is nonuniform and consistently complete burning of the vapors is not always achieved.

In another prior proposed vapor emission control system, known as the "balance" system, efficient operation of the system is affected by variable hot and cold conditions which cause difficulty in maintaining the balance required to meet the emission control standards.

Further, each gasoline service station is characterized by its own particular installation in that the distances between the gasoline dispensing pumps and the gasoline underground storage containers and also the distance to the disposal means creates a vapor system in which the pressure condition throughout the entire system may vary in terms of pressure drop in the vapor conducting lines. In the prior proposed system which includes the use of positive pressure to move vapors along a vapor conducting line to a disposal means, the presence of slight leaks anywhere along such system is not only hazardous, but also further affects the pressure variations in the system. There may be other features about a particular service station installation which may unfavorably affect the operation and efficiency of a vapor emission control system.

SUMMARY OF THE INVENTION

The present invention contemplates an apparatus and method for controlling gasoline vapor emissions which represents improvements in the apparatus and mode of installing and operating a vapor emission control system at a service station. The present invention contemplates improvements which reduce the amount of equipment required to effect complete burning of the gasoline vapors, which achieves over 99% disposal of excess vapors regardless of ambient conditions, and which includes economy and efficiency in equipment used over that proposed by the prior art.

Generally speaking, the present invention contemplates the reduction of multistage burners to a single burner, a reduction of pressure sensing switches to the use of one pressure sensing switch for a diurnal condition of operation and/or where vapor volume growth occurs during long periods of inactivity of pump-off conditions; and a second pressure sensing switch for a pump-on condition in which gasoline is being dispensed and transferred from tank to another tank. The invention further contemplates utilizing certain characteristics of the pressure sensing switch means to assure effective operation of the single burner means.

It is, therefore, a primary object of the present invention to provide economy and efficiency of operation of an apparatus and method for controlling vapor emissions at a gasoline service station.

A specific object of the present invention is to provide a vapor emission control system having a single burner means and a simplified arrangement of pressure sensing switch means and associated valve means for disposing of excess vapor emissions.

Another object of the invention is to disclose such an improved vapor emission control system which is readily adapted to an installed balanced vapor system.

A still further object of the invention is to provide a vapor emission control system which is inexpensive and which does not require a motor, a filter, a catalyst, refrigerant, carbon bed, lubrication, refractory material, or auxiliary fuel.

Further objects and advantages of the present invention will be readily apparent from the following description of the drawings in which an exemplary embodiment of the invention is shown.

IN THE DRAWINGS

FIG. 1 is a schematic view of a gasoline service station illustrating transfer paths of liquid gasoline and gasoline vapors between a delivery tank truck and an underground storage tank and between the storage tank and an automobile tank through service station gasoline pumps and hoses, and the transfer of gasoline vapors through vent pipes to a burning or disposal means for disposing of excess gas vapors under certain conditions.

Figure 1:
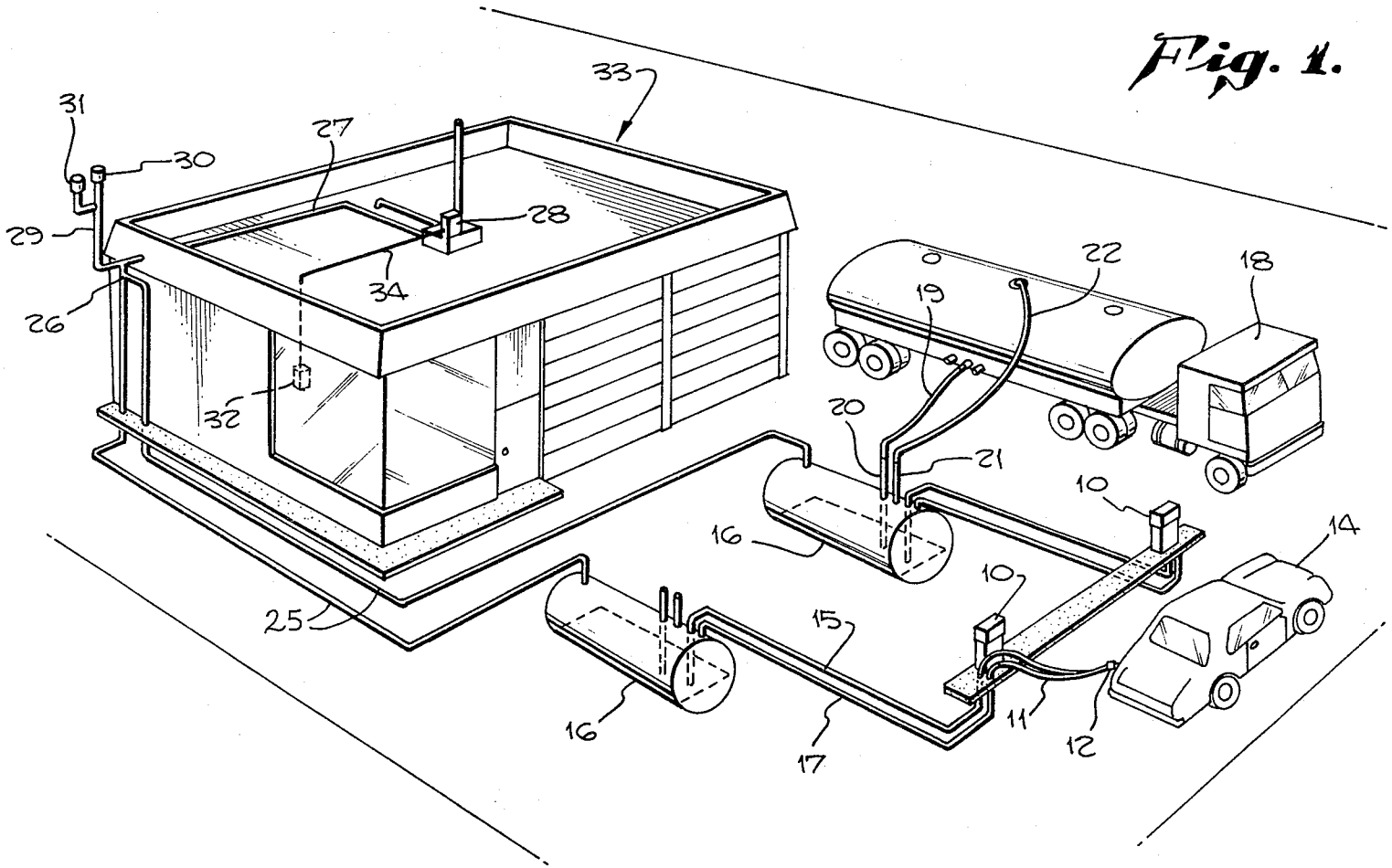

Referring first to FIG. 1, a gasoline service station schematically illustrated therein is provided with facilities for storage and dispensing of liquid gasoline and also for control and abatement of gasoline vapors in which excess vapors usually emitted to atmosphere are substantially eliminated by burning. Generally speaking, the service station illustrated in FIG. 1 includes an arrangement described in my U.S. Pat. No. 4,118,170 owned by a common assignee. The service station facilities which are common to said apparatus and method described in said copending application will be first mentioned.

In FIG. 1 a service station is shown with two gasoline pumps 10 each having liquid gasoline dispending hose means 11 provided with a nozzle 12 for insertion into a fill pipe for a vehicle gasoline tank of vehicle 14. Hose means 11 is illustrated as having two hose lines connected to nozzle 12; however, hose means 11 may constitute a single hose having two passageways therein, one of the passageways being for liquid gasoline transferred through line 15 from a storage tank 16 to the pump 10 and to the nozzle 12. The other hose line provides for passage of gasoline vapors from the vehicle tank through pipe 17 to storage tank 16. Nozzle 12 may be either a sealing or non-sealing type. A sealing type is a nozzle which has a flexible rubber boot which must be in sealed relation with the fill pipe before liquid is dispensed (no-seal, no-flow). A non-sealing type approximates a fit with the vehicle fill pipe. Vapor line 17 discharges vapor into the upper part of storage tank 16. It will be understood that tanks 16 may be underground and each may have different levels of liquid gasoline therein depending upon the amount of liquid gasoline dispensed through their respective pumps 10. The piping arrangement between each of the tanks 16, associated gasoline pump 10, and hose means 11 are the same and only one will be described as above.

FIG. 1 also illustrates the filling of underground tank or container 16 by a gasoline tank truck 18 having a fill line 19 entering underground tank 16 through an upstanding fill riser 20 which discharges liquid gasoline adjacent to the bottom of tank 16. Tank 16 also has an upstanding vent riser 21 which may be coupled to a vent line 22 leading to the upper chamber portion of tank truck 18 so that vapor will be returned from tank 16 to tank 18.

In each of the liquid gasoline transfer systems generally described above; that is, between the vehicle 14 and its gasoline storage tank and the underground storage tank 16 and between the tank truck 18 and an underground storage tank 16, the couplings and the lines are so constructed as to provide a closed substantially vapor tight circulation system for liquid gasoline and also vapors present in the system. Such transfer of gasoline vapors and liquids under a substantially closed vapor tight sealed system prevents loss of gasoline vapors to atmosphere at the fill nozzle 12 and at the fill coupling of the tank truck 18 to the underground tank 16. Gasoline vapors accumulating in the upper portions of underground storage tank 16 are permitted to flow through vent pipes 25, each connected to a tank 16, and manifolded at 26 to provide a flow path for excess gasoline vapors through vent pipe 27 which leads to a thermal oxidizer disposal or burner means generally indicated at 28 comprising, in this invention, a single burner and ignition means therefor as later described. Adjacent manifold 26 excess gasoline vapors are also in communication with an upstanding vent riser 29 having a blow-off valve 30 at the top thereof and having a pressure-vacuum valve 31 in communication with riser 29. Preferably, the generally horizontally disposed vent pipe 27 is pitched away from thermal oxidizer 28 so that condensate, which may occur in pipe 27, will be drained back to the manifold and toward the tanks 16. A remote control panel 32 may be located inside of the service station building schematically indicated at 33, said remote control panel 32 being connected to the thermal oxidizer 28 by cable 34.

Figure 2:
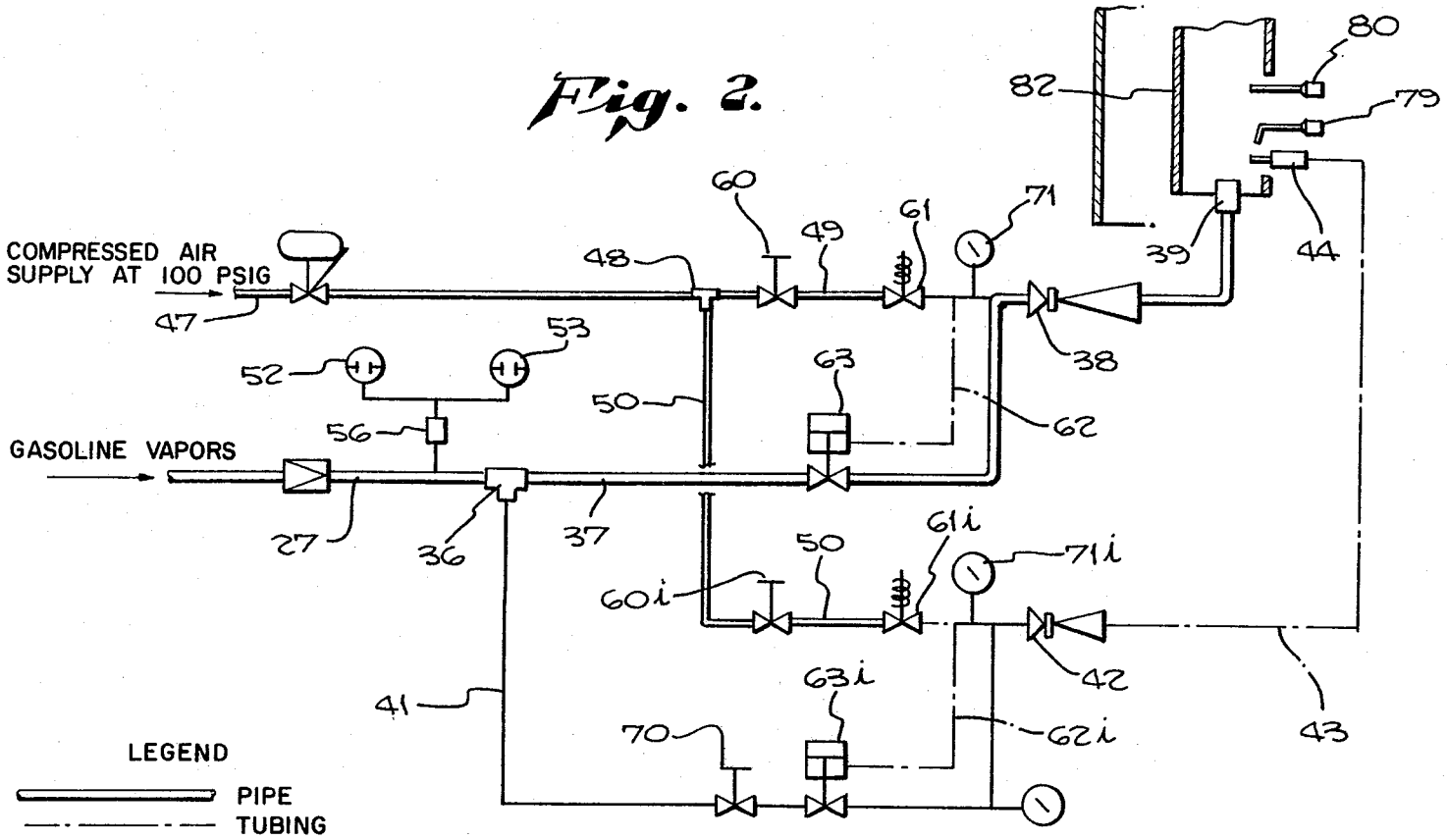
FIG. 2 is a schematic piping arrangement illustrating control of vent gas vapors from the underground storage containers.

FIG. 2 shows a schematic piping arrangement for such a thermal oxidizer 28 and includes vent pipe 27 for the gasoline vapors, vent pipe 27 having a T fitting 36 to divide gas vapor flow along a vapor conducting line 37 to an air gas booster 38 and to a single main burner 39. At T fitting 36, a pilot vapor line 41 leads to an air gas booster 42 which discharges into a tubing line 43 which leads to pilot or ignition burner 44.

The vapor emission control means also includes a compressed air source, not shown, which is generally available in gasoline service stations. Such service station air compressors normally have capability of supplying compressed air at 100 psig. A pressure air line 47 from such a source may be divided by a T fitting 48 into a pressure air line 49 which leads to air gas booster 38 and supplies pressure air thereto. At the T fitting 48, a second pressure air line 50 leads to and supplies pressure air to air booster 42 associated with the ignition burner 44.

Air gas boosters 38 and 42, or ejectors, do not use electrical power to operate and therefore obviate an explosion hazard present with the use of electrical motors.

In this invention two pressure sensing switches 52 and 53 are manifolded and connected through a pressure snubber 56 to vent pipe 27 at disposal means 28 to sense the pressure of vapors in vent pipe 27 and under selected pressure conditions to cause actuation of pilot burner 44 and main burner 39. Sensing of pressure of gaseous vapors in vapor line 27 also constitutes a measurement of pressure throughout the entire closed vapor system. It will be understood that the entire closed vapor system includes the vapor space above the liquid in tanks 16, the vapor space in hose means 11 and vapor line 17, the vapor space in vent line 22, the vapor space in vent pipes 25 and 27. At each service station, the location of the storage tanks 16, the gas dispensing pumps 10 and the disposal means 28 may substantially vary and may be subjected to varying other conditions of temperature, all of which will create varying pressure drop conditions in the vapor conducting pipes and lines. In addition at different service stations there may be different leakage conditions in the vapor conducting system which will also affect the pressure conditions in the vapor system. Under the present invention as hereinafter described, the setting of the two pressure sensing switches 52 and 53 at the disposal means 28 must take into account any pressure drop throughout the system and to maintain a slightly subatmospheric pressure at any point in the vapor system. Maintenance of subatmospheric pressure in the system prevents leakage of gaseous vapors outside the system, provides a slight vacuum at the dispensing nozzle, and at the same, time by maintaining a slightly subatmospheric pressure in the presence of some leakage the introduction of atmospheric air into the system is minimized.

One of the safety features of the present vapor emission control system is the provision of pressure air actuated valves in the gasoline vapor lines 37 and 41 to assure that there will be no flow of gasoline vapor to the burner means 44 or 39 unless the compressed air source is operable and pressure air is available through line 47 for moving the gas vapor to the burner means for providing combustion air sufficient to cause complete combustion of the vapor. As shown in FIG. 2, pressure air line 49 is provided with a manually actuated valve 60 upstream from a solenoid actuated valve 61. Solenoid valve 61 is actuated by one of the pressure sensing switches as later described and when moved to open position permits pressure air to flow into the air gas booster 38. Between booster 38 and the solenoid valve 61 an air line 62 is connected to pressure air line 49 and communicates pressure air with an air actuated valve 63 provided in main vapor conducting line 37 upstream from air gas booster 38. Pressure air communicating with valve 63 through line 62 causes actuation of valve 63 into open position to permit gas vapor to flow to air gas booster 38 and then to burner 39.

A similar system of air actuated valving is provided for the gasoline vapor pilot system in which the pressure air is used to pump gasoline vapor to a pilot burner 44. In FIG. 2 gasoline vapor conducting line 41 is connected to the main vapor conducting line 27 at the T fitting 36 to provide a small amount of gasoline vapor to air gas booster 42 and thence through line 43 to the ignition burner 44. Compressed air line 50 supplies a small amount of pressure air to air gas booster 42. As in the prior example, pressure air line 50 may be provided with a manually actuated valve **60*i* and a solenoid actuated valve 61*i*. Downstream of valve 61*i* a pressure air line 62*i* is connected to an air actuated valve 63*i* located in the pilot gasoline vapor line 41. A manually actuated valve 70 may be provided in line 41 upstream from the air actuated valve 63*i***.

Each pressure air line 49 and 50 may be provided with pressure gauges 71 and **71*i*, respectively, upstream from their respective air gas booster 38 and 42**.

The pilot system also includes a spark igniter 79 and a flame sensor 80 adjacent the pilot ignition burner 44 and at the bottom of a suitable stack means 82. Burner 39 and stack 82 are coaxially aligned, the lower portion of stack 82 having an opening of selected size to permit introduction of atmospheric air into the stack to provide a desired amount of air for accomplishing virtually complete combustion of the air vapor mixture discharged from burner 39.

Figure 3:
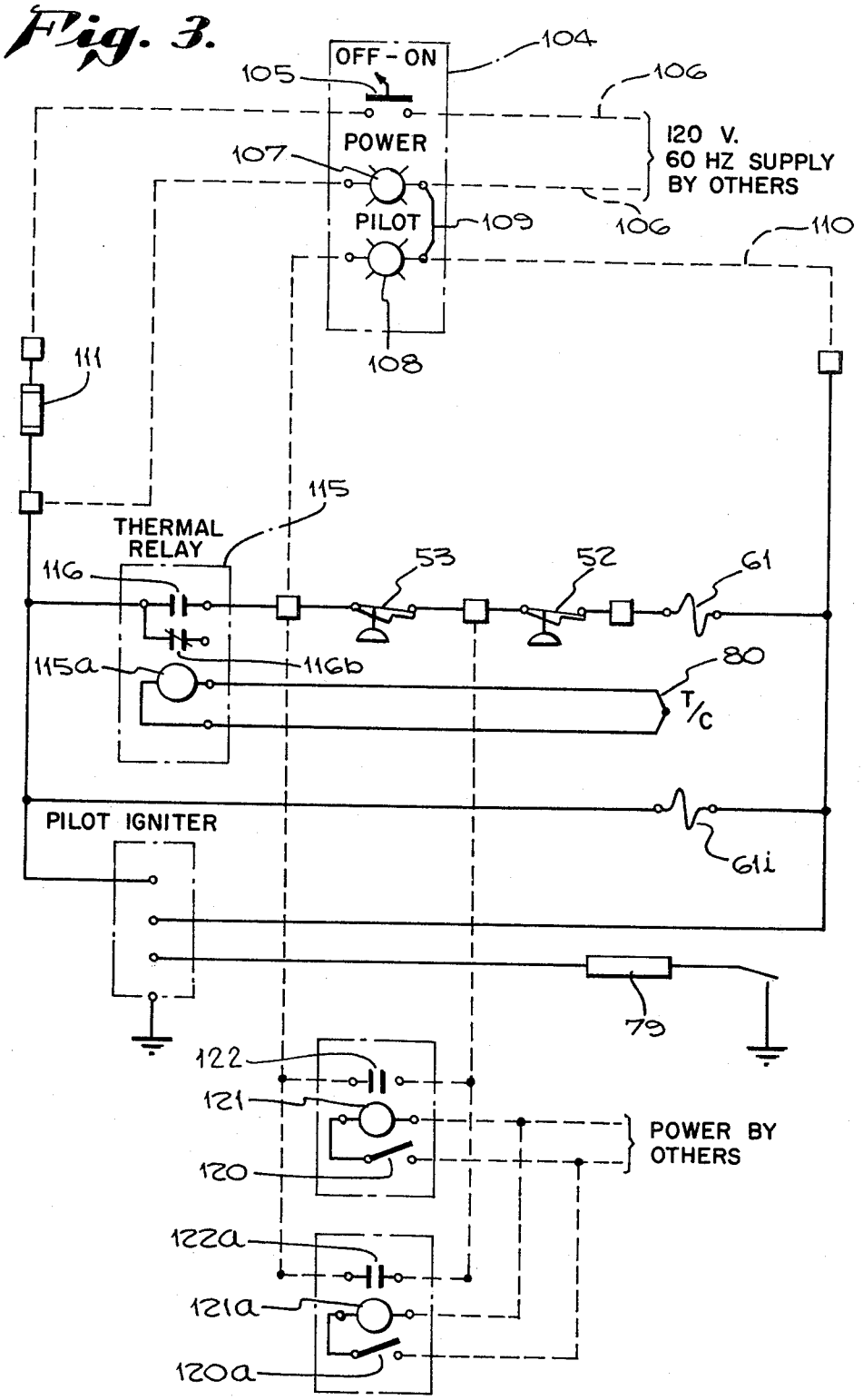
FIG. 3 is a schematic electrical diagram used with the control system shown in FIG. 2.

In FIG. 3, a schematic diagram is shown from which operation of the vapor emission control system described above will be readily apparent. The electric power supply may be a 120 volt 60 cycle power supply having power leads 106 entering a remote control station generally indicated at 104. At switching station 104 an on-off switch 105 is shown in off position, a power light 107 and a pilot light 108 are also located in the control panel. At the control panel, a jumper wire 109 is provided between power lead 106 and a lead 110. A suitable fuse 111 is connected between power leads 106. When on-off switch 105 is in on position, 107 will be illuminated to show that power is on and that a circuit is complete to the processing system.

If pressure air is available and power is supplied through power lead 106, jumper 109 and lead 110, pilot solenoid valve **61*i* is energized and supplies pressure air through line 62*i* to the ignition vapor valve 63*i* causing valve 63*i* to open and to direct ignition vapor to the air booster 42 and to the ignition burner 44. It will be apparent that ignition vapor valve 63*i* can be opened only when pressure air is available and is supplied to the air booster 42**.

The electric igniter 79 is activated to cause ignition of the air vapor mixture at burner 44. When a pilot flame has been established, the pilot light 108 will be illuminated to verify at the remote control panel that the pilot burner is operating. Further, only when the pilot flame is established will thermal relay 115 be activated to provide electrical power to the pressure control circuits for igniting burner 39. The thermal relay is provided with a thermal couple or flame sensor 80 which senses the presence of the pilot flame and upon the establishment of the pilot flame, thermal relay 115 will provide power to the main vapor conducting line and switch means through and by closing normally open contacts 116 in the thermal relay. In the thermal relay, a set of normally closed contacts **116*b*** are shown; however, these contacts are not used.

Means for controlling vapors in the system during transfer of liquid gasoline from the storage tanks to a vehicle tank under pump-on conditions includes the closing of switch 120 upon actuation of the pump. Closing of switch 120 energizes relay 121 which causes closing of contact 122. Pressure sensing switch means 52 shown in closed position provides completion of a circuit through contact 122, switch means 52, solenoid valve means 61, lead 110, and jumper 109 to power lead 106. Since the thermal couple 80 indicates that an ignition flame has been established and has caused actuation of relay **115*a* which closes contacts 116 in the thermal relay, a circuit is then completed around pressure sensing switch means 53 (which is shown closed although it may be open under some pump-on conditions) to cause actuation of solenoid valve means 61. Actuation of valve means 61 introduces pressure air through line 62 to valve means 63 which causes actuation of valve means 63 and which directs vapors in line 37 to the air-vapor booster 38. Air from line 49 is also introduced to the air-vapor booster 38 for providing an air-vapor mixture to burner 39 for ignition by the pilot flame at the pilot burner 44. Pressure sensing switch means 52 may be closed at pressures of vapor between $-\frac{1}{3}''$ WC and $-\frac{1}{2}''$ WC and thus under pump-on conditions provides for the direction and flow of excess vapor in the vapor conducting line 37** to the disposal means.

When vacuum pressure in the storage and vapor conducting line system reaches about $-\frac{1}{2}''$ WC, pressure sensing switch means 52 opens which then causes opening of the solenoid valve means 61 and closing of the vapor conducting valve means 63. Also, when the pump is returned to its non-dispensing position on the pumping station, switch 120 will be returned to open position, and contacts 122 will be opened to cause deactuation of the solenoid valve means 61 and the closing of the vapor conducting valve means 63.

Means for controlling vapors under diurnal conditions and where liquid gasoline is not being dispensed by the dispensing pumps is controlled by pressure sensing switch means 53 which is shown closed at a selected slightly subatmospheric pressure of about −0.1" WC. Under these conditions, pressure sensing switch means 53 in closed position completes a circuit between the closed thermal relay contacts 116 and closed switch means 52 and solenoid valve means 61 thereby causing opening of the valve means 63 in the main vapor conducting line. Pressure sensing switch means 53, under diurnal conditions and pump off conditions, will fluctuate between open and closed positions to maintain the vapor system in the storage tanks and vapor conducting line at a pressure slightly below atmospheric pressure; that is, about −0.1" WC.

The pressure in the storage containers and vapor conducting line is thus maintained at at least a slightly subatmospheric pressure under pump off conditions and reaches a greater subatmospheric pressure under pump-on conditions. Pressure sensing switch means 52, 53 are set to operate at different selected pressures so that a maximum amount of gasoline vapor may recondense in the storage tanks. This situation will occur during the periods that the station is on a pump-off condition. The gasoline vapor in the vapor system will be essentially saturated gasoline vapors of relatively constant BTU content. In the case of a very active and busy station, the emission control system will be operating mostly in a pump-on condition wherein excess vapors at a lower subatmospheric pressure are being moved to the disposal means and burned. In this respect, it should be noted that the pressure sensing switch means 52 and 53 and particularly switch means 53 operate with a small lag time or dead band. In other words, the switch means is not instantly responsive to the sensing of a subatmospheric pressure such as −0.1" WC so that the air actuated vapor valve in point of time instantly opens at the sensed pressure. Thus, in the case of pressure sensing valve means 53, sensing of a subatmospheric pressure of −0.1" WC will cause the system to begin operation during the approach of the pressure of the gaseous vapors to atmospheric pressure.

While examples of subatmospheric pressures have been indicated for pressure sensing switch means 52 and 53 for the purpose of this description, it will be understood that for different service stations the selected subatmospheric setting for each switch means 52, 53 may be varied from the examples given in order to assure that the pressure drop in the vapor lines and the presence of other conditions is accounted for so that at least a slight subatmospheric pressure is present at any location in the entire vapor system.

Since the gasoline vapors in the vapor system are essentially saturated vapors, the BTU content of the vapors is substantially constant. The air booster means 38 and 42 are fed by the compressed air supply at a constant known pressure and volume so that the air-vapor mixture introduced to the burner is substantially constant to provide full complete combustion regardless of pump-on or pump-off conditions.

In the event excess air should enter the vapor system, then the BTU content of the vapor will become leaner, the air gas vapor fed to the burner becomes lean, and before the mixture approaches an explosive condition, the burner will shut off because the mixture is too lean to sustain combustion. In addition, with a too lean mixture caused by excess air in the vapor system, the pilot, which is dependent upon gasoline vapors in the system, will also go out and causes shut down of the entire vapor control system.

It may be noted that pressure vacuum valve 31 may be set to relieve the vapor system at approximately +3" WC and −6" WC. Blow-off valve 30 may be set to relieve the system at +9" WC.

In the event the means for controlling pressure of gaseous vapors is not operable, the arrangement of vapor conducting lines and pressure vacuum relief valve permit the system to operate as a balance system. A vapor balance system is generally one where displaced vapors during a transfer operation are forced into the underground tank to prevent emission of the displaced vapors to atmosphere.

The operation of the above-described vapor control system utilizing a single burner at the disposal means, a single pressure sensing switch means for sensing pressure of vapors in pump-off condition to control pressure during diurnal and pump-off conditions, and a single pressure sensing switch means sensitive to pressure of vapors during a pump-on condition for handling excess vapors resulting from transfer of liquid gasoline between storage container and vehicle tank provides a demand-override system which maintains at least a slight vacuum on the gasoline storage system under all conditions of operation and inhibits the introduction of gasoline vapors to atmosphere. The circuitry shown in FIG. 3 clearly demonstrates a mode of operation in which the disposal burner means 28 will not be activated or will automatically shut down under the following conditions: if no electrical power is available, if the panel switch is in off position, if the pilot flame is not established by the pilot igniter 79, if the pressure air from the pressure air source is not available at the pilot vapor valve **63*i* or booster 42, and if pressure air is not available at the main air-vapor booster 38 and its correlated main vapor valve 63** in the main vapor conducting line.

It will be understood that, if desired, suitable flame arresters may be provided in the vapor lines. It should be noted in this respect that the vapor control system of this invention normally operates in such a manner that a flashback cannot occur because the high velocity of the air-vapor mixture in the orifice of the burner means 28 forcibly directs the air vapor flow upwardly into the stack. Upon closure of the valve means in the vapor conducting line and shutting off of air to the air vapor booster, there is no longer available sufficient air to support combustion.

A simplified inexpensive vapor control system embodying this invention has been certified, tested, and indicates to show an efficiency of over 99% in the destruction of unwanted vapors.

Any changes and modifications of the above apparatus and method coming within the scope of the appended claims are embraced thereby.

I claim:

1. In a method of installing a gasoline vapor control system for a gasoline service station having gasoline storage tanks in fluid communication with gasoline dispensing pumps having dispensing nozzles cooperable with a fill pipe on a vehicle tank, said fluid communication including a flow path for liquid gasoline and a flow path to return gasoline vapors from the fill pipe to the storage tanks, a vent means in communication with said storage tanks whereby gasoline vapors are collected in said vapor flow path, said storage tanks, and said vent means, and a vapor disposal means remote from said pumps and storage tanks and connected with said vent means, said disposal means including a burner means, a pilot means, and ignition means for said pilot means, a means for moving vapors to each of said burner means and pilot means, a pressure air source in communication with said moving means and valve means associated therewith, said pilot means and disposal burner means being operable only in the presence of a supply of pressure air to move said vapors in said system to the burners, and pressure sensing switch means in communication with said vent means, the steps of:

providing a single vapor burning means;

providing two pressure sensing switch means to comprise said pressure sensing means;

setting a first one of the two pressure sensing switch means at a pressure dependent upon pressure at any location in said vapor control system to just below atmospheric pressure regardless of pressure variations in said system, and actuating the disposal means to maintain said below atmospheric pressure as said pressure in said system approaches atmospheric pressure;

said first one of said pressure sensing switch means having a dead band whereby the selection of said just below atmospheric pressure and the pressure sensing switch means dead band provides both high and low response of the switch means for maintaining the selected just below pressure in the system.

2. In a method as stated in claim 1 including the step of:

setting the second one of said pressure sensing switch means at a second pressure to respond to a second subatmospheric pressure substantially below the setting of the first pressure sensing switch means whereby in gasoline dispensing pump-on condition excess vapor resulting therefrom is burned at said single vapor burning means;

said second pressure sensing switch means having a dead band whereby the selection of said second subatmospheric pressure and the second pressure switch means dead band provides both high and low response of the second switch means for causing burning of excess vapors when the system is in pump-on condition.

3. In a method as stated in claim 2 wherein the steps of setting said first and second pressure sensing switch means includes the step of providing variable settings of pressure at said first and second pressure sensing switch means which are correlated to conditions existing in the vapor flow paths of the vapor recovery system at each service station.

4. In a vapor emission control apparatus for a gasoline service station having gasoline pumps with dispensing nozzles having vapor return lines in communication with gasoline storage containers and vehicle tanks, said storage containers having a vent means in communication with vapor collected in said storage containers, with said vapor return lines, and with a disposal means, said dispensing nozzles being adapted for cooperable association with fill pipes on vehicle tanks, said disposal means including a pilot means including a pilot burner, a main burner means, a vapor moving means for each of said main burner means and pilot burner means, a pressure air source in communication with said moving means and valve means associated therewith adapted to be inoperable in the absence of pressure air, said disposal means being located remotely from said dispensing pumps and said storage containers whereby said vent means, said storage tanks, and said vapor return lines provide a vapor collecting system of varying length and size at different service stations and thereby resulting in variable pressure conditions throughout the vapor closed system, the combination of:

means for controlling vapors in said system under diurnal and pump-off conditions including, a first single pressure sensing switch in said vent means and set at a pressure setting to maintain at least just below atmospheric pressure in said system, the setting being dependent upon pressure variations therein;

and means for controlling vapors in said system during transfer of liquid gasoline between said storage containers and said vehicle tank under pump-on conditions including, a second single pressure sensing switch in said vent means for responding to pressures at a range substantially below the aforementioned subatmospheric pressure;

said disposal means consisting of a single burner for oxidizing vapors under both diurnal, pump-off conditions and pump-on conditions;

said first and second pressure sensing switches being provided with selected dead bands whereby each switch provides both high and low response for maintenance of selected subatmospheric pressures in said system.

* * * * *